United States Patent [19]

Paffhausen et al.

[11] Patent Number: 4,886,386

[45] Date of Patent: Dec. 12, 1989

[54] INK RIBBON HAVING ELASTOMERIC PROTECTIVE BACKING

[75] Inventors: Hans Paffhausen, Franklin, Tenn.; Ian Hogarth, Turriff, Scotland; Andrew Scott, Turriff, Scotland; Christine Mackintosh, Turriff, Scotland

[73] Assignee: Caribonum Ltd., Turriff, Scotland

[21] Appl. No.: 103,528

[22] Filed: Sep. 30, 1987

[30] Foreign Application Priority Data

Oct. 15, 1986 [DE] Fed. Rep. of Germany ..... 3635112

[51] Int. Cl.[4] ..... B41J 31/12

[52] U.S. Cl. ..... 400/241.4; 400/240; 400/240.4; 400/241.1

[58] Field of Search ..... 400/240, 240.2, 240.4, 400/241, 241.1, 241.2, 241.4, 124

[56] References Cited

U.S. PATENT DOCUMENTS

| | | | |
|---|---|---|---|
| 2,066,687 | 1/1937 | Hudspeth | 400/241.4 |
| 3,162,290 | 12/1964 | Knight | 400/241.1 X |
| 3,287,153 | 11/1966 | Schwarz et al. | 400/241.2 X |
| 3,330,791 | 7/1967 | Mater et al. | 400/241.2 X |
| 3,671,287 | 6/1972 | Maniar | 400/241.2 X |
| 3,682,764 | 8/1972 | Findlay et al. | 400/241.1 X |
| 4,016,321 | 4/1977 | McIntyre, Jr. | 400/241.4 X |
| 4,321,286 | 3/1982 | Scott et al. | 400/241.2 X |
| 4,426,168 | 1/1984 | Jozuka et al. | 400/124 X |
| 4,472,072 | 9/1984 | Harada et al. | 400/124 |
| 4,515,489 | 5/1985 | Kohle et al. | 400/241.2 |
| 4,544,292 | 10/1985 | Kohle et al. | 400/241.2 |
| 4,569,609 | 2/1986 | Snyder, Jr. et al. | 400/241.4 |

FOREIGN PATENT DOCUMENTS

| | | | |
|---|---|---|---|
| 0167932 | 1/1986 | European Pat. Off. . | |
| 0169705 | 1/1986 | European Pat. Off. | 400/241.1 |
| 525191 | 5/1931 | Fed. Rep. of Germany . | |
| 2815344 | 2/1983 | Fed. Rep. of Germany . | |
| 3214305 | 8/1984 | Fed. Rep. of Germany . | |
| 3307432 | 1/1986 | Fed. Rep. of Germany . | |
| 0049987 | 3/1985 | Japan | 400/241.4 |
| 0225778 | 11/1985 | Japan | 400/241.1 |
| 473679 | 1/1936 | United Kingdom | 400/241.4 |

OTHER PUBLICATIONS

IBM Technical Disclosure Bulletin, "Ribbon Support Film Coating", Findlay et al., vol. 15, No. 2, Jul. 1972, p. 368.

IBM Technical Disclosure Bulletin, "Ink Barrier For A Mulicolor Printer Ribbon", vol. 27, No. 3, Aug. 1984, p. 1824.

IBM Technical Disclosure Bulletin, "Multi-Color Ink Ribbon Cassette", Kanno et al, vol. 26, No. 12, May 1984, pp. 6570–6571.

Textbook of Polymer Science, Billmeyer, Jr., Published By Interscience, A Division of John Wiley and Sons, New York, London, Sydney, p. 567.

DIN 7724, Grouping of high-polymeric materials on the basis of effect of temperature on mechanical behavior, Feb. 1972.

*Primary Examiner*—Ernest T. Wright, Jr.
*Attorney, Agent, or Firm*—Herbert Dubno

[57] ABSTRACT

An overlappingly overstrikeable ink ribbon for matrix or needle printing systems is described having a carrier film and an ink-releasing coating, as well as optionally further conventional intermediate coatings. A rubber-elastic layer is formed on the needle impression side. A process for producing this ribbon is also described. This ribbon has many advantages compared with known ribbons. It protects the print head, withstands the needle pressure for a longer time due to the elastic layer and improves the printing definition. It can be produced by coextrusion of the starting materials of the carrier film and the rubber-elastic layer.

7 Claims, 1 Drawing Sheet

INK RIBBON HAVING ELASTOMERIC PROTECTIVE BACKING

FIELD OF THE INVENTION

Our present invention relates to an overlappingly overstrikeable ink ribbon for matrix or needle printing systems with a carrier film and at least one ink-releasing coating and, optionally, further conventional intermediate coatings. The invention also relates to a process for the production of the new ribbon.

BACKGROUND OF THE INVENTION

Overlappingly overstrikeable ribbons for matrix printing systems with a carrier film are already known. The carrier film is made from a plastic, which can e.g. be of a thermosetting or thermoplastic nature. When using such ribbons in matrix printing systems many different disadvantages are encountered. The needles rapidly cause perforations and deformations which consequently damage the carrier film and make the ribbon unusable, particularly on passing through several times. These disadvantageous effects lead to unsatisfactory clarity or definition. The problem is particularly significant with a newer matrix printing system with a larger number of needles per surface unit and with finer needles.

OBJECT OF THE INVENTION

The object of the invention is, therefore, to provide an improved overlappingly overstrikeable ribbon for matrix printing systems, which largely prevents perforation and deformation of the ribbon by the action of the needles in use which affords satisfactory printing definition.

SUMMARY OF THE INVENTION

According to the invention this object is attained by providing on the side of the needle impression layer of a rubber-elastic (elastomeric) material.

When choosing the starting material for the carrier film of the ribbon according to the invention no significant limitations are imposed. It is possible to use the conventionally employed plastics in this field, which can e.g. be of a thermosetting or thermoplastic nature. Polyester and polypropylene films have proved to be particularly advantageous in practice. Polyethylene terephthalate is of particular significance among the polyesters. The thickness of the carrier film is not decisive, but it is generally advantageous if it does not exceed 30 micrometers and is approximately 10 micrometers.

The ribbon according to the invention has an elastic material layer on the side where needles act in matrix printing systems during the printing process. Within the context of the invention, the term "elastic material" is to be understood in the broadest sense and covers in particular "elastomers". This is the collective term for synthetic and natural polymers with rubberlike characteristics. According to German Industrial Standard DIN 7724 and the February 1972 supplement, elastomers are "wide-meshed high polymers crosslinked up to the decomposition temperature, which behave in steel-elastic manner at low temperatures and which even at high temperatures do not flow in a viscous manner and are instead rubberlike from 20° C. or a lower temperature to the decomposition temperature. The rubberlike nature is characterized by substantially temperature-independent shear modulus values between approximately 0.1 and 100 MPa and a large reversible deformability." The elastomers comprise long, tangled polymer chains, which are crosslinked in a wide-mesh manner with one another. As a result of the crosslink bonding (adhesion points, e.g. sulphur or ether bridges introduced by vulcanization) in the case of tensile and compressive stressing the chains are prevented from sliding past one another (flowing away). The characteristics of the elastomers can be varied by fillers, stabilizers, etc. Natural rubber or butadiene-styrene copolymers can e.g. also be vulcanized by microwaves. Important elastomers within the scope of the invention are e.g. natural rubbers (NR), synthetic rubbers, e.g. butadiene-chloroprene rubber (BCR), ethylenevinylacetate (EVA), isobutylene-isoprene rubber (IIR), nitrile-butadiene rubber (NBR), polyurethane elastomer (PUE), styrene-butadiene rubber (SBR), acrylic rubber, fluoroelastomers, polyolefins, polyphosphorus nitride chloride, polysulphides, silicone rubbers and polyurethane rubbers.

In the broadest sense, a rubber is a high polymeric, mainly plastic substance, which by vulcanization is transformed into a highly elastic state and thereby loses its solubility in organic solvents. These rubber materials are applied in low viscosity form, e.g. in the form of a solution to one side of the carrier film of the inventive ink ribbon and subsequently undergo vulcanization. Vulcanization accelerators, e.g. xanthogenates, dithiocarbamates and tetramethylthiuram disulphide, can be added. Vulcanization can be effected by heat action or by evaporation of the solvent and leads to the desired elastic material.

Appropriately in producing the laminate from the carrier film and the elastic layer, the starting materials of the rubberlike products are used as a basis and are applied in an appropriate form, particularly in the dissolved form, to the carrier film and are vulcanized there. It is possible to use starting materials of natural and synthetic rubbers.

Within the scope of the invention, it is advantageously possible to use thermoelastic elastomers for producing the elastic layer on the ribbon carrier film. According to German Industrial Standard DIN 7724 and the February 1972 supplement, the thermoelastic elastomers ae high polymers which are so crosslinked in wide-mesh manner up to the decomposition temperature that the polymer molecules are no longer in a position to perform macro-Brownian movements at any temperature. However, micro-Brownian movements are possible between the glass transition temperature (in the case of amorphous polymers) or the melting point (in the case of partly crystalline polymers), both of which are by definition above 0° C., and the decomposition temperature. Typical thermoelastic elastomers are wide-meshed crosslinked polyethylene and polypropylene. Through a coextrusion of a thermoplastic carrier material and the thermoelastic material, it is in particular possible to produce the composite structure constituted by the carrier film and the elastic layer.

There are no significant restrictions in choosing the elastic material for forming the elastic layer of the inventive ribbon. It is known from the prior art how the elastomer material and possibly the starting materials used have to be chosen in order to ultimately obtain the desired composite structure constituted by carrier film and elastic layer. The essence of the invention is that, as will be shown hereinafter, the composite structure provides particularly advantageous and extremely surprising results when correctly used in matrix printing systems.

Thus, in the process for producing the inventive ink ribbon, it is preferable to proceed in such a way that the starting materials for the elastic layer and the carrier film, which during or after extrusion are subject to crosslinking or are thermoplastically deformable, are coextruded and subsequently the ink-releasing coating is applied in a conventional manner.

It is fundamentally also possible to process finished elastic films from the aforementioned materials with a finished carrier film to give a laminate, conventional laminating adhesives appropriately being used for providing adhesive characteristics. Materials of this type are known. The adhesion-imparting coating of the laminating adhesive is preferably approximately 3 to 10 micrometers thick.

A particularly advantageous procedure for forming the elastic layer of the laminate structure will now be described. It has proved advantageous to use commercially available solvent-soluble, non-reactive polyurethane rubbers or resins for producing the elastic layer, which are applied in solution to the carrier and are physically dried. These e.g. include the linear aromatic polyurethane marketed under the trade name "Desmolac 2100" by Bayer AG, Leverkusen. These materials have completely reacted, but compared with a conventional fully reacted polyurethane resin, which is crosslinked three-dimensionally and insoluble in solvents, have a mainly linear structure, optionally with branched side chains and generally also have a lower molecular weight. They can be derived from aromatic or aliphatic hydrocarbons. To obtain the desired elasticity, the solution of said polyurethane resin applied must be supplied with a trifunctional isocyanature or a corresponding prepolymer (with isocyanate group at least at the ends thereof). Triisocyanurates with free NCO groups are polyisocyanates, which are derived from isocyanuric acid, in that their three H-atoms are replaced by hydrocarbon radicals, which in turn carry free NCO groups. Within the scope of the invention this NCO isocyanurate is added to the solution containing the solvent-soluble, non-reactive polyurethane resin. The solvents can be methyl ethyl ketone, toluene and the like. It cannot react with the polyurethane resin, because the latter no longer contains any NCO-reactive OH-groups, but it e.g. reacts with water from the air or solvents to a three-dimensional polyurethane system, which passes through the layer of solvent-soluble, non-reactive polyurethane resin and thereby additionally strengthens the same. The NCO isocyanurate can e.g. be constituted by the products supplied by Bayer AG, Leverkusen under the name "Haftvermittler 2005".

The quantity ratio of the two aforementioned reactants is not critical. As a rough guideline approximately one part by weight of NCO isocyanurate can be used for approximately 5 to 30 parts by weight of polyurethane resin. However, in the individual case, it is possible to go above or below these ranges. After evaporating the solvent, a crosslinking reaction leads to a fully elastic material, which meets in a very adequate manner the requirements of the invention. The elasticity in the sense of a better "needle pliability" can be favorably influenced in that a plasticizer, e.g. from the group of phthalic acid esters is incorporated into the solution applied.

The thickness of the two layers of the laminate structure of carrier film and elastic layer is not critical. Advantageously the elastic layer thickness is approximately 20 to 30% of the total thickness of the composite film (carrier film/elastic layer). The composite film preferably has a thickness of approximately 5 to 50 micrometers, particularly 10 to 40 micrometers and in particularly preferred manner the thickness is 20 to 30 micrometers.

For producing the ready-to-use ink ribbon according to the invention, the ink-releasing coating is applied to the remaining free side of the carrier film. It is possible to apply random ink pastes, optionally in solution and if a solvent is present the latter is evaporated to ultimately form the ink-releasing coating. The finished ink-releasing coating can be in the form of a plastic matrix with an oil-based ink paste dispersed therein and which contains dyes and/or ink pigments and optionally fillers and wetting agents, as described in German patents Nos. 32 14 305 and 33 07 432.

According to German patent No. 32 14 305 the oil base of the ink paste is a mineral oil containing 25 to 40% aromatic hydrocarbons, in which 30 to 40% of the saturated-bonded C-atoms are cycloaliphatically bonded. The advantageously used wetting agent belongs to the group of fatty amine salts. If fillters are used, they are preferably finely divided, storage-active fillters with a high internal surface area. The viscosity of the ink paste contained in the ink-releasing coating is approximately 4,000 to 10,000 mPa.s (20° C.).

In order to obtain particularly favorable overstrike values with the ribbon according to the invention, use is advantageously made of the ink paste described in German patent No. 33 07 432. According to the latter the ink-releasing coating obtained after evaporating the solvent of an ink paste applied comprises a plastic matrix with an oily paste dispersed therein and containing carbon black and/or other ink pigments, as well as fillers with a large inner surface and with a particle size distribution of approximately 0.2 to 40, particularly 0.2 to 20, micrometers. The oil is a polyethoxylated fatty acid ester of a polyhydric alcohol and an excellent solvent for oil-soluble or fatty dyes. The polyethoxylated fatty acid ester is preferably an ester of fatty acids with approximately 12 to 25 C-atoms and alcohols with 3 to 6 OH-groups, approximately 20 to 60 ethoxy groups being contained in the molecule. Particular preference is given to a polyoxyethylene-(40)-sorbitan pentaoleate to octaoleate as the polyethoxylated fatty acid ester. Reference should be made to the aforementioned patent specification for further details.

Diverging from the statements made in German patent No. 33 07 432 the filler proportion of the ink-releasing coating can be omitted if the ribbon is used in continuously filled cassettes and it can be placed in the cassette in a more or less loose loop form. Thus, unlike the case of a spool there is no excessive pressing effect between the contacting ribbon surfaces. The inventive ribbons housed in continuously filled cassettes have a particularly high yield, if the ink paste is applied in a larger quantity, which is not prejudicial here, there being no sticking due to "oiling out".

Prior to the formation of the ink-releasing coating, it is possible to apply an adhesive coating to the carrier film, particularly if an extremely high number of overstrikes are required. Particularly suitable materials for forming an adhesive coating are described in detail in German patent No. 28 15 344, to which reference is made. If the laminate structure provided with such a coating giving adhesion and static characteristics is wound up, then a thin antistatic coating can also be formed on the elastic layer surface. This can be advantageous in certain cases. Such an antistatic coating can be separately applied to the elastic layer by conventional methods. It preferably has a thickness of approximately 1 to 10 micrometers, the range 2 to 7 micrometers being especially preferred.

Different ink-releasing coatings of different colors can be applied in juxtaposed and successive manner on the ribbon according to the invention, so that the latter can be used for multicolor printing or typing. These can e.g. be the primary colors yellow, blue-green and purple-red making high-fidelity color printing possible. It is also possible to provide a black strip, so that simultaneously normal characters can be printed. In order to supply high-fidelity multicolor prints, it is consequently approppriate to choose the three primary colors yellow, blue-green and purple-red. Therefore color pictures, which are very similar to a color original can be reproduced on a copy sheet or page by producing images corresponding to the particular color signals produced by the color separation of the original with separation filters, i.e. blue, green and red three-color filters.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
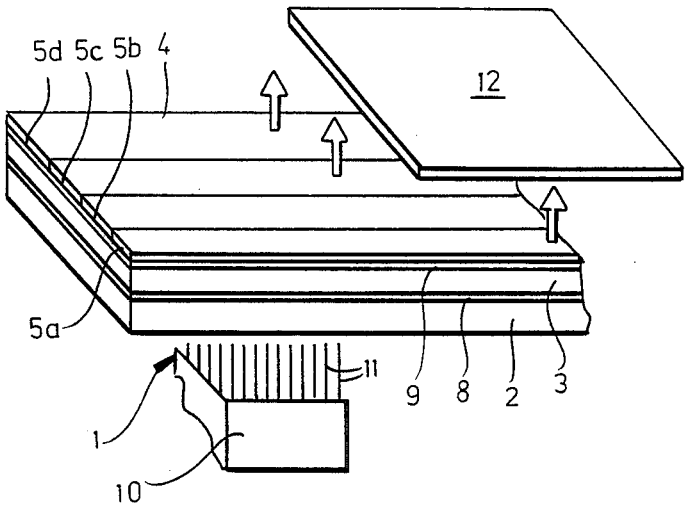
FIG. 1 is a perspective view of a portion of an ink ribbon for multicolor printing.

According to FIG. 1 the ink ribbon 1 has an elastic or elastomer layer 2 formed from a crosslinked synthetic rubber (polyurethane), a carrier film 3 and an ink-releasing coating 4. The latter is subdivided into strips 5*a*, 5*b*, 5*c* and 5*d*, strips 5*a*, 5*b* and 5*c* having the three primary colors, yellow, purple-red and blue-green, while the final color strip 5*d* is black.

Figure 2:
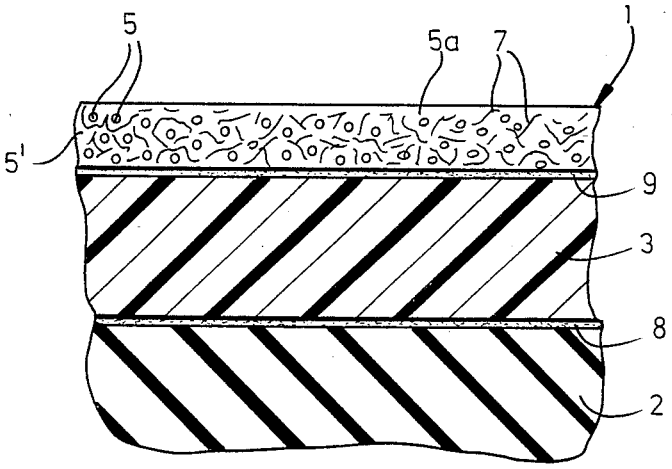
FIG. 2 is a detail section of a portion of the ribbon according to FIG. 1.

FIG. 2 is an enlarged detail section of the region of color strip 5*a* showing that each ink strip comprises a plastic matrix 7, which contains a homogeneous ink paste 5' and carbon black particles 5 incorporated therein and is applied to a polyester (polyethylene terephthalate) carrier film 3. Ink paste 5' contains the fatty dye Sudan deep black (C.I. 26150) dissolved in polyoxyethylene sorbitan septaoleate with approximately 40 ethoxy groups per molecule.

When desired, an adhesive layer 8 can be provided to laminate the elastomer layer 2 to the carrier film 3 and intermediate layers 9 can be provided between the film 3 and the ink-releasing coating 4.

The inventive ribbon 1 has numeraous advantageous. Compared with the known products of the same film thickness, it is able to longer withstand the neede pressure of the needle printing system 10, 11, because the needles 11 do not directly strike the carrier film 3 and are instead cushioned by the elastic layer 2. Therefore perforations and deformations are largely prevented. As a result of the elastic coating the ribbon 1 is better and more reliably passed in a cassette for continuous drive purposes. As a result of the aforementioned damping of the needle action, the needles 11 are subject to reduced wear and the print head 10 of the matrix printing system 10, 11 has a longer life. There is a further advantage compared with a cloth ribbon in that the needles 11 no longer penetrate into the ribbon 1 and therefore do not carry ink with them on retraction. As a result, better defined printing and higher marginal definitions are obtained. This also leads to a better "dot definition" in the color-receiving surface 12, because the elastic layer material adapts itself directly to the surfaces of the needles 11 of the matrix printing system 10, 11.

The inventive ribbon 1 can be used for black prints and color prints with equally advantageous results. The hitherto known systems employing a cloth ribbon as the carrier can be constructed as follows. The ink strips in the cloth ribbon can be juxtaposed, but also successively arranged in order to produce high fidelity color copies. To permit a better explanation reference is made to the last mentioned embodiment of the known cloth ribbon. This cloth ribbon is generally partly wound onto a first reel and partly onto a second reel, where there are three ink-releasing coatings with the particular primary colors following one another. In the case of a color cloth ribbon a special linking of the strips is necessary. If the ribbon is e.g. made from Nylon, bonding is necessary at the connecting points and an intermediate portion must be provided so that the colors do not pass into one another. This bonding or welding is labor-intensive and the intermediate portion ca be prejudicial during color printing. The other aforementioned deficiencies of cloth ribbons also occur here. An advantage of the ribbon 1 of the invention is based on the fact that a single unitary carrier film 3 with the three differently colored and successive ink strips 5*a*, 5*b* and 5*c*, i.e. with the three primary colors can be provided, without the need for the aforementioned disadvantageous connecting measures. The time taken for bonding is roughly 1/10 of that necessary for welding the color strips of the known Nylon cloth ribbon.

The advantages of the inventive ribbon 1 are apparent even when it is not only in the form of a narrow ribbon or tape, but also in the form of a relatively wide sheet of blanket.

It might be assumed that there is no need for the actual carrier film 3 and that e.g. a hard rubberlike layer could be suitable as the carrier. However, it has been found in practice that this does not lead to the desired results, because rubber supports are too soft to fulfil the necessary functions in the cassette. Admittedly the thickness of the elastic layer could be increased, but this would have to take place to such an extent that there would no longer be the desired elasticity with respect to the needle action. There would also be a deterioaration to the printing definition. A purely rubber layer also involves problems because of the difficulty of adequately firmly binding the ink-releasing material, even when using an adhesion-imparting layer. In addition, the oil of the ink-releasing coating tends partly to migrate into the elastic layer.

SPECIFIC EXAMPLE 20 parts by weight of a polyurethane resin (tradename "Desmolac 2100") were mixed with 80 parts by weight of methyl ethyl ketone, to which was added 1 part by weight of a NCO-isocyanate (marketed by Bayer AG, Leverkusen under the name "Haftvermittler 2005"). This solution was applied to a 10 micrometer thick polyethylene terephthalate carrier in a quantity such that after evaporating the methyl ethyl ketone, the elastic layer was formed in a thickness of 10 micrometers, so that the composite film had a total thickness of 20 micrometers. The following mixture was then applied to the carrier film for forming the ink-releasing coating: mixture of 18.1 parts by weight of polyoxyethylene sorbitan septaoleate (with an average 40 ethoxy groups per molecule), 9.6 parts by weight of oil-soluble black (C.I. 26150) (30% in the above polyoxyethylene sorbitan septaoleate), 2.3 parts by weight of tallow oil diaminooleate, 2.1 parts by weight of blue pigment (C.I. 42765-1), 7.0 parts by weight of carbon black, 45.3 parts by weight of polyvinyl chloride/acetate (25% in methyl ethyl ketone), 8.8 parts by weight of filler (diatomaceous earth), 15 parts by weight of methyl ethyl ketone and 21.6 parts by weight of toluene. By applying this mixture and by evaporating the solvent (methyl ethyl ketone or toluene) an ink-releasing coating approximately 16 micrometers thick was formed on the above laminate film.

When used in matrix printing systems the ribbon produced in the above manner does not cause perforations and deformations even when used for a long time, while giving excellent printing definitions.

We claim:

1. A printing system which comprises:

a matrix printing head with a multiplicity of needles deployable for generating an image; and an overlapping overstrike ribbon cooperating with said head for forming said image, said ribbon comprising:

a synthetic resin carrier film having a side turned toward said head and another side turned away from said head, a cross-linked elastomer layer coated on said side turned toward said head and engageable by said needles, said elastomer layer having a resiliency sufficient to prevent penetration of said needles into said ribbon but enabling transfer of impact through said elastomer layer and said film affording high definition of said image, and a color-release layer on said another side of said carrier film and comprising a synthetic resin matrix and at least one ink material of at least one color, said color-release layer being capable of transferring said image to a color-receiving surface.

2. The printing system defined in claim 1 wherein said color-release layer on said another side of said carrier film comprises a plurality of strips containing ink materials of different colors capable of forming a multicolor image.

3. The printing system defined in claim 1 wherein said cross-linked elastomer layer has a thickness which is approximately 20 to 30% of the thickness of said carrier film.

4. The printing system defined in claim 3 wherein said thickness of said cross-linked elastomer layer is approximatey 15 to 60 micrometers.

5. The printing system defined in claim 1 wherein said ribbon is provided with a laminated adhesive coating between said carrier film and said cross-linked elastomer layer.

6. The printing system defined in claim 5 wherein said adhesive coating has a thickness of approximately 3 to 10 micrometers.

7. A method for producing an overstrike ribbon which comprises the steps of:

(a) coextruding a synthetic resin carrier film and a cross-linked elastomer layer on one side of said carrier film, said elastomer layer having a resiliency sufficient to prevent penetration of matrix printing head needles into said ribbon but enabling transfer of impact through said elastomer layer and said film affording high definition of an image to be produced by said ribbon; and (b) applying a color-release layer on an opposite side of said carrier film for generating said image and transferring said image to a color-receiving surface.

* * * * *